US007468088B1

(12) United States Patent
Blankenhorn et al.

(10) Patent No.: US 7,468,088 B1
(45) Date of Patent: Dec. 23, 2008

(54) ALUMINUM COMPOSITE COMPOSITION AND METHOD

(75) Inventors: Matthew E. Blankenhorn, Ironton, OH (US); William F. Clifford, Sr., Canton, OH (US)

(73) Assignee: Aluminastic Corporation, Ironton, OH (US)

( * ) Notice: Subject to any disclaimer, the term of this patent is extended or adjusted under 35 U.S.C. 154(b) by 0 days.

(21) Appl. No.: 11/211,182

(22) Filed: Aug. 23, 2005

Related U.S. Application Data

(63) Continuation of application No. 10/292,208, filed on Nov. 12, 2002, now abandoned, which is a continuation-in-part of application No. 09/799,910, filed on Mar. 6, 2001, now abandoned.

(60) Provisional application No. 60/189,684, filed on Mar. 15, 2000.

(51) Int. Cl.
*C22B 4/02* (2006.01)

(52) U.S. Cl. ..... 75/10.18; 75/10.59

(58) Field of Classification Search ..... 75/10.18, 75/10.59; 148/549
See application file for complete search history.

(56) References Cited

U.S. PATENT DOCUMENTS

| | | | | |
|---|---|---|---|---|
| 3,947,265 | A * | 3/1976 | Guzowski et al. | 75/10.23 |
| 4,159,906 | A | 7/1979 | Meichsner et al. | 75/307 |
| 5,021,087 | A | 6/1991 | Morton | 75/678 |
| D337,828 | S | 7/1993 | Gordon | D24/220 |
| 5,376,160 | A | 12/1994 | Neuer et al. | 75/304 |
| 5,401,338 | A | 3/1995 | Lin | 148/538 |
| 5,915,637 | A | 6/1999 | Parsons | 241/168 |
| D433,148 | S | 10/2000 | Dennis | D24/220 |
| 6,149,710 | A * | 11/2000 | Gonzalez et al. | 75/684 |
| 6,592,812 | B1 | 7/2003 | Kubota et al. | 420/542 |
| 6,637,683 | B1 | 10/2003 | (Lomax) Wilbur | 241/101.2 |
| 6,637,685 | B1 | 10/2003 | Kruger | 241/169.1 |
| D497,543 | S | 10/2004 | Buckley | D9/707 |
| D502,267 | S | 2/2005 | Leyshon et al. | D24/220 |

OTHER PUBLICATIONS

"ASM Handbooks: vol. 15 Casting", ASM International, 2002, p. 1-5, http://products.asminternational.org/hbk/index.jsp.*
Henry, Scott D. et al, ASM Specialty Handbook, Aluminum and Aluminum Alloys, p. 41, 1993.
Libby, W. F., Theory of Metallic Diamond, Physical Review, vol. 130, No. 2, Apr. 15, 1963, pp. 548-549.
Guyer, Ruth Levy et al., Diamond: Glittering Prize for Materials Science, Science, Dec. 1990, 3 pp.
Petry, Corinna C., Metals Build Momentum in Construction, Metal Center News Online, Sep. 2001, 10 pp.
Narayan, J. et al., Enhancement of Nucleation and Adhesion of Diamond Films on Copper, Stainless Steel, and Silicon Substrates, Journal of Applied Physics, vol. 71, Issue 2, Jan. 15, 1992, pp. 966-971.
Johnson, William B., Diamond/A1 Metal Matarix Composites Formed by the Pressureless Metal Infiltration Process, Journal of Materials Research, vol. 8, No. 5, p. 1169 (1996).
Browne, Malcom W., Diamond May Prove Ideal Display Screen, New York Times, Sep. 28, 1993, 3 pp.
Method of Metallizing a Diamond Substrate Without Using a Refractory Metal, Technology Transfer Fact Sheet, http://www.nsa.gov/techtrans/techt00044.cfm (1996).
Chepurov, A.A., Experimental Study of Diamond Crystallization in Metal—Silicate—Carbon Systems, Russian Fundamental Research Foundation (Project No. 99-05-64687) pp. 76-77, 2000.
Chen, Yen-Deh et al., Metastable Growth of Diamond in Molten Alloy, Kinik Company, Taipei, Taiwan, R.O.C. and National Taipei University of Technology, Taipei, Taiwan, 2 pp., 2001.
Kohn, E. et al., Diamond A New Materials Base for Future Ultra High Power RF Electronics, Dept. of Electron Devices and Circuits, University of Ulm, Ulm Germany, 4 pp., 2004.
Pickard, S.M. et al., Diamond/AL Composites for Thermal Management of Next Generation Power Electronic Devices, 2 pp., 2001.
Sonuparlak, Birol et al., Silicon Carbide Reinforced Aluminum for Performance Electronic Packages, PCC Advanced Forming Technology, Metal Matrix Composites Business Unit, 9 pp., 2004.

* cited by examiner

*Primary Examiner*—Roy King
*Assistant Examiner*—Janelle Morillo
(74) *Attorney, Agent, or Firm*—Roger A. Gilcrest

(57) ABSTRACT

One aspect of the invention is a method for incorporating carbon homogeneously into aluminum materials. The first step is to apply a positive charge to molten aluminum. Next, a negative charge is applied to an organic compound. Under an inert atmosphere, the negatively charged organic compound is mixed with the positively charged molten aluminum while running electric current therethrough. An aluminum material with carbon homogeneously dispersed throughout is recovered.

19 Claims, No Drawings

ALUMINUM COMPOSITE COMPOSITION AND METHOD

CROSS-REFERENCE TO RELATED APPLICATIONS

This application is a continuation of Ser. No. 10/292,208 filed Nov. 12, 2002, now abandoned, which is a continuation-in-part of Ser. No. 09/799,910 filed Mar. 6, 2001 now abandoned, which is based on provisional 60/189,684 filed Mar. 15, 2000. The disclosures of said continuation-in-part and provisional applications are expressly incorporated herein by reference.

STATEMENT REGARDING FEDERALLY SPONSORED RESEARCH

Not applicable.

BACKGROUND OF THE INVENTION

The present invention relates generally to aluminum composite compositions and more particularly to and aluminum composite composition of increased homogeneous carbon content for creating a heat-treatable material that is harder, tougher, and lighter per volume than standard aluminum.

Heat-treating of aluminum parts is common practice, but one which is limited because it typically involves immersion of the aluminum part in high carbon concentration liquids which produces surface hardness but leaves a soft aluminum core. The resulting heat-treated aluminum parts have obvious deficiencies due to the inner core that was not hardened by the heat-treatment process. Heat-treating of metals, e.g., steel, is known to depend upon the carbon content of the metal. Unless the carbon content of the aluminum can be increased, it cannot be hardened to the same degree as can, for example, steel.

The need to materials that are strong and lightweight is obvious. Traditional materials that were lightweight were not sufficiently strong, and those that were strong, were too heavy. For example, the automotive industry would like to reduce the weight of vehicles to improve fuel economy without sacrificing safety and without prohibitively increasing the cost of the vehicle. Aluminum offers the weight reduction that they seek, but not the hardness of the steel that it replaces.

Heretofore, U.S. Pat. No. 5,401,338 proposes to make an aluminum alloy matrix composition by forming a heated, ultrasonically oscillated reinforcing material ($Al_2O_3$, SiC, SiN, etc.) aqueous suspension, which is sprayed onto the surface of heated aluminum held under continuous agitation. Degassing follows this procedure.

U.S. Pat. No. 5,021,087 proposes to improve the casting properties of aluminum by placing a hydrogen-containing treating gas blanket over molten aluminum.

U.S. Pat. No. 5,376,160 proposes to alloy Ti, Mo, B with iron or steel by adding granules of the iron or steel that encapsulate decomposable organic polymers (polyethylene, polypropylene, polystyrene) and the alloying metal. The molten iron or steel melts the granules, which releases the organic polymers that decompose into gas that agitates the melt.

U.S. Pat. No. 4,159,906 proposes to desulfurize pig iron with calcium carbide or calcium cyanamide and an agent (polyethylene, polyamide) that releases water or hydrogen at molten pig iron temperatures.

The present invention is addressed to hardening the complete hardening of aluminum parts.

BRIEF SUMMARY OF THE INVENTION

One aspect of the invention is a method for incorporating carbon homogeneously into aluminum materials. The first step is to apply a positive charge to molten aluminum. Next a negative charge is applied to an organic compound. Under an inert atmosphere, the negatively charged organic compound is mixed with the positively charged molten aluminum while running electric current therethrough. An aluminum material with carbon homogeneously dispersed throughout is recovered.

DETAILED DESCRIPTION OF THE INVENTION

The invention increases the amount of carbon molecules present in the aluminum matrix. While prior processes could surface harden aluminum, the invention has the ability to distribute the carbon molecules throughout the aluminum matrix: thus, hardening the entire aluminum matrix. Hardened aluminum is tougher and stronger than untreated Al. Moreover, such hardened Al maintains its lightness in weight, because the added hardening material is carbon (molecular weight of 12). In fact, the density of the novel hardened Al is less than untreated Al (e.g., 99.5% Al) by dint of the presence of carbon molecules in the matrix.

Al also is prized in industry due to its machinability. The novel hardened Al has the same ease of machinability as does untreated Al. The novel hardened Al also can be cast, molded, extruded, and otherwise processed just as pure Al and Al alloys. Thus, uses of the novel hardened Al are expected to be the same as Al is today with substitution for steel (e.g., automotive or other industrial application) likely.

The first step in manufacturing the novel hardened Al is to form a melt of Al. This most conveniently is accomplished by meting the Al feedstock in a crucible at a temperature ranging from about 1400° F. to 2000° F. Conventional equipment and handling procedures are practiced in this step. The Al feedstock can be an alloy or can be pure (99.5%, for example) aluminum.

Next, electrodes are placed in the Al melt. Steel or other conventional material is used for the electrodes. The electrodes are connected to a source of voltage ranging from about 12 to 200 volts. While DC current is preferred, AC current will function to harden the Al feedstock.

A source of carbonaceous or organic material is provided. The carbonaceous source can be virtually any convenient carbon source. The carbonaceous material, however, is not a metal carbide or ceramic carbide, which are conventional reinforcements for aluminum. For present purposes, then, "organic compound" comprehends carbonaceous materials substantially devoid of organometallic content. For example, virtually any thermally decomposable organic polymer can be used including, for example, one or more of polyethylene, polypropylene, polystyrene, or the like. Preferably, the Al feedstock will be positively charged and a source of carbon will be negatively charged before being mixed.

Before mixing the Al feedstock with the carbonaceous material, an inert gas atmosphere is established above the Al melt. Any convenient inert gas can be use, such as, for example, argon, nitrogen, carbon dioxide, or the like. This inert gas blanket controls the flames from the carbonaceous material added to the Al melt.

Next, the carbonaceous material is added to the Al melt, desirably in small aliquots while the Al melt is being stirred. The electrodes can accomplish stirring if necessary, desirable, or convenient. Heat can be added to the mixture, as needed, in order to maintain the desired temperature of the melt. If the mixture becomes difficult to stir (viscous), the temperature of the mixture can be increased.

Testing has proved that the weight of the product is greater than the Al feedstock weight. Carbon has been incorporated into the Al matrix. Such carbon incorporation will be generally homogeneous if adequate mixing of the materials has been achieved.

Once the carbonaceous material has been added, the mixture can be additionally heated, if necessary, to pouring temperature and the product cast, molded, extruded, or otherwise formed into an intermediate or final product. Importantly, carbon has been incorporated into the Al matrix for its hardening.

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In this application all units are in the metric system and all amounts and percentages are by weight, unless otherwise expressly indicated. Also, all citations referred herein are expressly incorporated herein by reference.

EXAMPLES

Example 1

Aluminum (2,443 g) was melted at 1450° F. in a crucible. An inert atmosphere (argon gas) was maintained over the aluminum melt. Aliquots of low-density polyethylene (LDPE) were made in approximately 100 g additions. After the initial melt temperature was reached heating was discontinued. Reheating of the melt was undertaken periodically as detailed below.

Two steel probes were immersed into the Al melt and connected to a 12-volt DC battery. Three additions of the LDPE were made to the charged Al melt. The furnace was fired up to bring the melt temperature up to 1550° F.

After another three additions of LDPE, the furnace again was fired up to bring the melt temperature up to 1550° F.

After another five additions of LDPE, furnace once again was fired up to bring the melt temperature up to 1550° F.

At this time the 12-volt battery source was removed and a Hobart welder (100 volts) was connected to the melt through the two steel probes (electrodes). The last two additions of LDPE was made at this time.

The Al melt then was poured into sand molds to form an ingot. The remaining melt in the crucible was cooled and weighed. The total weight for the melt residue in the crucible and the ingot was 2,453 g. Given the initial Al weight in the crucible was 2,443 g, this means that 10 g of LDPE was incorporated into the Al melt in the crucible.

The ingot was subjected to hardness testing using a Rockwell Hardness tester calibrated on a 63.8 gage block that tested at 64.1. The minor load used was 10 kg and the major load used was 150 kg.

Example 2

In this example, the Al melted in the crucible weighed 2451 g and 1553 g of LDPE was added thereto in the same manner as described in connected with Example 1. In this example, however, a 100-volt AC source was used. It was observed that burn off seemed to take longer with AC current compared to DC current. Moreover, only 2 g of LDPE was incorporated into the Al melt.

Example 3

Example 2 was repeated, but with DC voltage was used with 2451 g of Al and 1553 g of LDPE. The initial Al melt temperature was 1550° F. A 100-volt DC current source again was used.

After the initial 4 additions of LDPE, the melt temperature was raised to 1600° F.

After an additional 3 additions of LDPE, the temperature of the melt in the crucible was raised to 1700° F.

After an additional 3 additions of LDPE, the temperature of the melt in the crucible was raised to 1700° F. The melt in the crucible was thickening and mixing seemed to be better than with the AC current.

After an additional 4 additions of LDPE, the temperature of the melt in the crucible was raised to 1750° F.

After the final 3 additions of LOPE were made, the material in the crucible was heated to pouring fluidity and an ingot was cast in a sand mold.

The total weight of the ingot and residual material in the crucible was 2543 g. This means that 92 g of LDPE was incorporated into the Al. The ingot had a Rockwell hardness value of about 130 (C Scale).

Example 4

A total of 2280 g of Al was melted in the crucible. The current source was 120-volts DC and the total amount of LDPE to be added was 1553 g.

After the initial 3 additions of LDPE, the temperature of the crucible contents was raised to 1700° F.

After an additional 2 additions of LDPE, the material became too thick, so the temperature was raised to 1600° F.

After the additional 3 additions of LDPE, the temperature of the crucible contents was raised to 1600° F.

After the additional 2 additions of LDPE, the temperature of the crucible contents was raised to 1700° F.

After the additional 3 additions of LDPE, the temperature of the crucible contents was raised to 1700° F.

After the final 3 additions of LDPE, the material was heated to 1700° F. and an ingot was poured.

The total weight of material (ingot plus crucible residue) was 2296 g, indicating an incorporation of 16 g of material from the LDPE Rockwell hardness readings of the ingot ranged from about 135.4 to 158.2 (C scale).

Example 5

A total of 2280 g of Al and 1553 of LDPE was used in this example with the DC current source set at 150 volts DC. The initial melt temperature of the Al was 1500° F.

After the initial 3 additions of LDPE, the temperature of the crucible contents was raised to 1700° F.

After the additional 3 additions of LDPE, the temperature of the crucible contents was raised to 1700° F.

After the additional 4 additions of LDPE, the temperature of the crucible contents was raised to 1700° F.

After the additional 4 additions of LDPE, the temperature of the crucible contents was raised to 1700° F.

After the additional 3 additions of LDPE, the temperature of the crucible contents was raised to 1700° F.

After the final 3 additions of LDPE, the temperature of the crucible contents was raised to 1700° F. for casting.

The total weight of material (ingot plus crucible residue) was 2308 g, indicating an incorporation of 28 g of material from the LDPE.

Example 6

A total of 2280 g of Al and 1553 of LDPE was used in this example with the DC current source set at 200 volts DC. The initial melt temperature of the Al was 1500° F.

After the initial 3 additions of LDPE, the temperature of the crucible contents was raised to 1700° F. The material was considerably thicker than in the other runs. It appears that with higher voltages, more material is being incorporated into the melt. Thus, the temperature was raised to 1800° F.

After the additional 3 additions of LDPE, the temperature of the crucible contents was raised to 1800° F.

After the additional 4 additions of LDPE, the temperature of the crucible contents was raised to 1800° F.

After the additional 3 additions of LDPE, the temperature of the crucible contents was raised to 1800° F.

After the final 3 additions of LDPE, the temperature of the crucible contents was raised to 1800° F. for casting.

The total weight of material (ingot plus crucible residue) was 2299 g, indicating an incorporation of 19 g of material from the LDPE.

Example 7

A total of 2286 g of Al and 1553 of LDPE was used in this example with the DC current source set at 200 volts DC. The initial melt temperature of the Al was 2000° F.

After the initial 7 additions of LDPE, the temperature of the crucible contents was raised to 1700° F.

After the additional 4 additions of LDPE, the temperature of the crucible contents was raised to 1700° F.

After the additional 4 additions of LDPE, the temperature of the crucible contents was raised to 1700° F.

After the additional 3 additions of LDPE, the temperature of the crucible contents was raised to 1700° F.

After the final 2 additions of LDPE, the temperature of the crucible contents was raised to 1700° F. for casting.

The total weight of material (ingot plus crucible residue) was 2296 g, indicating an incorporation of 10 g of material from the LDPE.

Example 8

A total of 2280 g of Al and 1553 of LDPE was used in this example with the DC current source set at 150 volts DC. The initial melt temperature of the Al was 1700° F.

After the initial 6 additions of LDPE, the temperature of the crucible contents was raised to 1700° F.

After the additional 4 additions of LDPE, the temperature of the crucible contents was raised to 1700° F.

After the additional 3 additions of LDPE, the temperature of the crucible contents was raised to 1700° F.

After the additional 4 additions of LDPE, the temperature of the crucible contents was raised to 1700° F.

After the final 2 additions of LDPE, the temperature of the crucible contents was raised to 1700° F. for casting.

The total weight of material (ingot plus crucible residue) was 2300 g, indicating an incorporation of 20 g of material from the LDPE.

Example 9

All of the leftovers from Examples 1-8 were reheated and an ingot poured. The ingot weighed 5590 g and the leftover in the crucible as 2692 g. At 2000° F. the ingot still could not be poured. The thermometer used could not register over 2000° F. Nevertheless, heating was continued until the material was fluent enough to pour the ingot.

Example 10

Sand cast ingots cast from additional runs were subjected to evaluation. Test pieces were machined into various sizes using a 115" vertical band saw with a fine-toothed blade (between 16 and 22 teeth). Each test piece was assigned a serial number, as set forth below (only those test pieces evaluated will be displayed, rather than all the test pieces made):

TABLE 1

| Serial No. | Shape | Length (in) | Width (in) | Height (in) | Diameter (in) |
|---|---|---|---|---|---|
| AC001 | Bar | 9.740 | 0.792 | 0.490 | — |
| AC002 | Disk | — | — | 0.398 | 3.00 |
| AC003 | Disk | — | — | 0.150 | 3.00 |
| AC004 | Plate | 4.990 | 1.464 | 0.200 | — |
| AC011 | Bar | 9.530 | 0.865 | 0.612 | — |
| AC012 | Disk | — | — | 0575 | 2.825 |
| AC013 | Bar | 9.525 | 0.864 | 0.596 | — |
| AC014 | Disk | — | — | 0.300 | 2.750 |
| AC015 | Bar | 5.268 | 0.515 | 0.548 | — |
| AC016 | Bar | 5.837 | 1.400 | 0.655 | — |
| AC019 | Bar | 9.638 | 0.829 | 0.468 | — |
| AC020 | Bar | 9.268 | 0.797 | 0.706 | — |

Some of these test pieces were machined using a ⅞" HSS 4 flute 3" cutter at a low spindle speed of 800 rpm and a feed rate restricted to about 6 in/min. This cutter performed well. The chips produced were approximately ½ to ¾ inches in length with a thickness ranging from about 0.003 to 0.005 in. The machinist reported that the samples had the feel of 6000 series aluminum.

The second cutter was a ¾" HSS 6 flute 2⅕" cutter. The feed rate was slowed to 6 in/min to keep the cutter from binding up. This caused vibrations in the machine, which resulted in a poor surface finish.

After machining, samples AC002, AC003, AC012, and AC014 were subjected to polishing using an 80 grit sanding belt. Next, each sample was sequentially rubbed with 100, 120, 180, and 200 grit sand paper. Samples AC002, AC012, and AC014 then were polished on two bench wheel buffers with one being finer than the other. The results were impressive with a mirror-like finish being produced.

Rockwell Hardness testing (ASTM D 785, M Scale, ¼" diameter ball, 10 kg minimum load and 100 kg maximum load) was performed on several of the samples with the following results being recorded.

TABLE 2

| Serial No. | Mass (g) | Top Side (in) | Bottom Side (in) |
|---|---|---|---|
| AC001 | 164 | 70.2 | 66.6 |
| | | 56.8 | 66.1 |
| | | 50.6 | 59.9 |

TABLE 2-continued

| Serial No. | Mass (g) | Top Side (in) | Bottom Side (in) |
|---|---|---|---|
| | | 42.1 | 57.8 |
| | | 63.3 | 65.1 |
| AC002 | 118 | 63.3 | 70.9 |
| | | 67.4 | 65.8 |
| | | 62.7 | 67.3 |
| | | 76.6 | 67.3 |
| | | 68.9 | 66.2 |
| AC003 | 39 | 72.4; 72.2 | 62.0; 74.0 |
| | | 69.4; 74.3 | 74.2; 73.9 |
| | | 63.9: 67.8 | 70.9; 69.3 |
| | | 74.7; 62.9 | 71.9; 65.1 |
| AC004 | — | 75.6 | 75.9 |
| | | 74.2 | 77.3 |
| | | 63.7 | 65.8 |
| | | 60.4 | 64.7 |
| | | 78.7 | 29.9 |
| AC011 | 220 | 60.3 | 60.7 |
| | | 53.3 | 63.0 |
| | | 59.4 | 57.2 |
| | | 62.9 | 66,1 |
| | | 68.1 | 69.7 |
| AC012 | 156 | 30.4 | 36.3 |
| | | 74.5 | 67.8 |
| | | 62.2 | 78.8 |
| | | 60.3 | 62.8 |
| | | 71.9 | 36.6 |
| AC013 | 213 | 71.6 | 66.6 |
| | | 56.7 | 62.1 |
| | | 56.5 | 59.6 |
| | | 65.4 | 65.8 |
| | | 69.3 | 71.0 |
| AC014 | 71 | 64.3 | 58.3 |
| | | 69.2 | 22.9 |
| | | 74.6 | 34.5 |
| | | 71.7 | 40.3 |
| | | 68.0 | 62.4 |
| AC015 | 64 | 72.6 | 73.6 |
| | | 71.3 | 71.7 |
| | | 68.0 | 70.9 |
| | | 76.5 | 70.5 |
| | | 71.5 | 70.7 |
| AC016 | 232 | 57.3 | 6.7 |
| | | −6.7 | 68.6 |
| | | 46.1 | 67.4 |
| | | 33.0 | 74.4 |
| | | 70.2 | 75.7 |
| AC019 | 160 | 69.2 | 74.0 |
| | | 74.4 | 61.0 |
| | | 75.6 | 72.9 |
| | | 74.0 | 68.6 |
| | | 74.5 | 65.0 |
| AC020 | 155 | 74.2 | 76.3 |
| | | 75.0 | 71.1 |
| | | 67.6 | 69.0 |
| | | 61.1 | 67.0 |
| | | 71.9 | 76.7 |

The following table displays the heat treating schedule and Rockwell Hardness numbers (M scale, ¼" diameter ball, 10 kg minimum load, and 100 kg maximum load) for several of the samples.

TABLE 3

| Serial No. | Heat Treat Schedule | Top Side (in) | Bottom Side (in) |
|---|---|---|---|
| AC001 | 600° C. | 52.9 | 68.9 |
| | 1 hour | 67.6 | 63.7 |
| | | 54.1 | 59.9 |
| | | 55.9 | 67.4 |
| | | 63.2 | 71.2 |
| AC013 | 600° C. | 71.6 | 66.6 |
| | 1 hour | 56.7 | 62.1 |
| | | 56.5 | 59.6 |
| | | 65.4 | 65.8 |
| | | 69.3 | 71.0 |
| AC015 | 600° C. | 70.9 | 72.6 |
| | 1 hour | 72.3 | 71.3 |
| | | 72.9 | 68.0 |
| | | 71.5 | 76.5 |
| | | 76.0 | 71.5 |

Important in assessing the foregoing Rockwell Hardness number is the knowledge that 99.5% Al will register approximately 30 on the Rockwell M scale. Values for the inventive samples tested are approximately twice that value.

Next tensile testing (ASTM D638, ISO 527-1) and flexural testing (ASTM D 790, ISO 178) were undertaken on four of the DC current samples (precise number not recorded).

TABLE 4

| Type 1 Test Bars | Tensile Strength (ksi) |
|---|---|
| Test bar 1 | 2626.473 |
| Test bar 2 | 2599.503 |
| Test bar 3 | 2647.297 |
| Test bar 4 | 2672.042 |
| Mean | 2636.329 |

These date represent tensile strengths that are in excess of those of untreated aluminum.

Example 11

Test samples of the products of Examples 1-3 product were machined, and subjected to Rockwell C Scale Hardness (highest scale) testing (M Scale (normal measurement scale) using ¼" diameter ball, 10 kg minor load, and 100 kg maximum load).

TABLE 5

| Ser. No. | Shape | Mass (g) | Length (in) | Width (in) | Thickness (in) | Height (in) | Diameter* (in) | Rockwell Hardness (average) |
|---|---|---|---|---|---|---|---|---|
| AC025 | Triangle | 16 | 1.937 | — | 0.373<br>0.772 | 0.870 | — | 47.24 |
| AC026 | Triangle | 6 | 1.505 | — | 0.350 | 0.643 | — | 47.24 |
| AC027 | Triangle | 9 | 2.282 | — | 0.335 | 0.675 | — | 47.24 |

TABLE 5-continued

| Ser. No. | Shape | Mass (g) | Length (in) | Width (in) | Thickness (in) | Height (in) | Diameter* (in) | Rockwell Hardness (average) |
|---|---|---|---|---|---|---|---|---|
| AC028 | Semi-circle | 19 | — | — | 0.342 | — | 2.282 | 47.24 |
| AC029 | Triangle | 14 | 2.423 | — | 0.354 | 0.821 | — | 47.24 |
| AC030 | Triangle | 9 | 1.827 | — | 0.351 | 0.821 | — | 47.24 |
| AC031 | Square | 4 | 1.500 | 1.850 | 0.062 | — | — | 47.24 |
| AC032 | Rectangle | 35 | 3.805 | 0.600 | 0.400 | — | — | 47.24 |
| AC033 | Rectangle | 13 | 1.500 | 0.577 | 0.659 | 0.305 (tip) | — | 47.24 |
| AC034 | Triangle | 6 | 1.195 | — | 0.325 | 0.690 | — | 47.24 |
| AC035 | L-Shape | 52 | 3.630 | 2.860 | 0.342 | 1.059 | — | 47.24 |
| AC036 | Rectangle | 52 | 5.349 | 1.538 | 0.367 | — | — | 47.24 |
| AC037 | Rectangle | 41 | 5.676 | 0.550 | 0.367 | — | — | 47.24 |
| AC038 | Semi-circle | 51 | — | — | 0.320 | 2.547 | 2.820 | 47.24 |
| AC039 | Bar | 39 | 3.007 | 1.358 | 0.265 | — | — | 47.24 |
| AC040 | Annulus | 59 | — | — | 0.502 | — | 0.748 (ID) | 47.24 |
| | | | | | 0.392 | | 2.283 (OD) | |
| AC041 | Annulus | 128 | — | — | 0.832 | — | 0.678 (ID) | 47.24 |
| | | | | | 0.708 | | 2.665 (OD) | |
| AC042 | Annulus | 39 | — | — | 0.369 | — | 0.725 (ID) | 47.24 |
| | | | | | 0.371 | | 2.250 (OD) | |
| AC043 | Annulus | 129 | — | — | 0.828 | — | 0.740 (ID) | 47.24 |
| | | | | | 0.673 | | 2.435 (OD) | |
| AC044 | Annulus | 131 | — | — | 0.864 | — | 0.782 (ID) | 47.24 |
| | | | | | 0.757 | | 2.889 (OD) | |
| AC045 | Annulus | 132 | — | — | 0.840 | — | 0.748 (ID) | 47.24 |
| | | | | | 0.799 | | 2.707 (OD) | |
| ACC46 | Annulus | 133 | — | — | 0.856 | — | 0.727 (ID) | 47.24 |
| | | | | | 0.721 | | 2.593 (OD) | |
| AC047 | Annulus | 49 | — | — | 0.433 | | 0.720 (ID) | 47.24 |
| | | | | | 0.314 | | 2.294 (OD) | |
| AC045 | Triangle | 20 | 1.981 | — | 0.304 | 1.896 | — | 47.24 |
| AC049 | Triangle | 19 | 1.923 | — | 0.397 | 1.310 | — | 47.24 |
| AC050 | Rectangle | 38 | 3.215 | 1.704 | 0.180 | — | — | — |
| AC051 | Rectangle | 37 | 3.216 | 1.557 | 0,177 | — | — | — |
| AC052 | Rectangle | 37 | 3.217 | 1.550 | 0.174 | — | — | — |
| AC053 | Rectangle | 1243 | 6.489 | 5.532 | 1.027 | — | — | — |
| AC054 | Square | 8 | 0.707 | 0.777 | 0.376 | — | — | — |
| AC055 | Rectangle | F18 | 1.954 | 0.774 | 0.284 | — | — | — |

*ID Is Inside diameter, OD is outside diameter

We claim:

1. Method for incorporating carbon homogeneously into an aluminum feedstock for forming a hardened aluminum product, which comprises the steps of:

(a) applying a charge to molten aluminum feedstock;

(b) mixing an organic compound with said charged molten aluminum while running electric current therethrough, so as to provide a concentration of carbon in said charged molten aluminum greater than about 0.08 weight-percent; and (c) recovering said hardened aluminum product with carbon homogeneously dispersed throughout.

2. The method of claim 1, wherein a positive charge ranging from between about 12 and 200 volts is applied to said molten aluminum feedstock.

3. The method of claim 2, wherein said charge applied to said molten aluminum feedstock is dc current.

4. The method of claim 1, wherein said charge applied to said molten aluminum feedstock is dc current.

5. The method of claim 1, wherein said organic compound comprises a thermally decomposable organic polymer.

6. The method of claim 5, wherein said decomposable organic polymer is one or more of polyethylene, polypropylene, or polystyrene.

7. The method of claim 1, wherein said mixing step (b) is conducted under an inert gas atmosphere.

8. The method of claim 7, wherein said inert gas atmosphere is one or more of argon, nitrogen, or carbon dioxide.

9. The method of claim 1, wherein step (b) is conducted at a temperature ranging from about 1400° to 2000° F.

10. The method of claim 1, wherein the concentration of carbon in said charged molten aluminum following step (b) is greater than 3.5 weight-percent.

11. The method of claim 1, wherein the concentration of carbon in said charged molten aluminum created in step (b) is in the range of between about 0.08 and about 1.2 weight-percent.

12. The method of claim 1, wherein the concentration of carbon in said charged molten aluminum created in step (b) is in the range of between about 0.08 and about 3.5 weight-percent.

13. The method of claim 1, wherein at least two electrodes of opposing charge are in contact with said molten aluminum feedstock during step (b).

14. Method for incorporating carbon homogeneously into an aluminum feedstock for forming a hardened aluminum product, which comprises the steps of:

(a) preparing a molten aluminum feedstock having an electric current therethrough, homogeneously incorporating into said molten aluminum feedstock a concentration of carbon greater than 0.08 weight-percent; and (b) recovering a hardened aluminum product from said molten aluminum feedstock.

15. The method of claim 14 wherein the concentration of carbon in said charged molten aluminum created in step (a) is in the range of between about 0.08 and about 1.2 weight-percent.

16. The method of claim 14, wherein the concentration of carbon in said charged molten aluminum created in step (a) is in the range of between about 0.08 and about 3.5 weight-percent.

17. Method for incorporating carbon homogeneously into an aluminum feedstock for forming a hardened aluminum product, which comprises the steps of:

(a) preparing a molten aluminum feedstock having an electric current therethrough by having at least two electrodes of opposing charge are in contact with said molten aluminum feedstock, said molten aluminum feedstock having a concentration of carbon greater than 0.08 weight-percent homogeneously incorporated into said molten aluminum feedstock; and (b) recovering a hardened aluminum product from said molten aluminum feedstock, said hardened aluminum product having a concentration of carbon greater than 0.08 weight-percent.

18. The method of claim 17 wherein the concentration of carbon in said hardened aluminum product is in the range of between about 0.08 and about 1.2 weight-percent.

19. The method of claim 17 wherein the concentration of carbon in said hardened aluminum product is in the range of between about 0.08 and about 3.5 weight-percent.

* * * * *